United States Patent [19]

Zuniga

[11] 4,297,754

[45] Nov. 3, 1981

[54] BOX SPRING AND MATTRESS SUPPORT DEVICE

[76] Inventor: Julio A. Zuniga, 2310 Powell St., San Francisco, Calif. 94133

[21] Appl. No.: 102,012

[22] Filed: Dec. 10, 1979

[51] Int. Cl.[3] ..... A47C 21/00

[52] U.S. Cl. ..... 5/411; 5/508

[58] Field of Search ..... 5/100, 200, 207, 309, 5/411, 426, 508

[56] References Cited

U.S. PATENT DOCUMENTS

| | | | |
|---|---|---|---|
| 3,402,409 | 9/1968 | Kain | 5/426 |
| 3,474,473 | 10/1969 | Hannaberg | 5/426 |
| 3,818,519 | 6/1974 | Schuder | 5/411 |
| 4,017,919 | 4/1977 | Hemmeter | 5/411 |
| 4,070,718 | 1/1978 | Spitz | 5/207 |

*Primary Examiner*—Roy D. Frazier
*Assistant Examiner*—Alexander Grosz
*Attorney, Agent, or Firm*—Bielen and Peterson

[57] ABSTRACT

A box spring and mattress support device utilizing an upright member and a clip for holding the upright member to the support member of the bed frame which includes an element extending from an upright member which forms a channel intended for encompassing at least a portion of the bed frame and thereby supporting the device in an upright position adjacent the box springs and mattress.

8 Claims, 8 Drawing Figures

20
18
10
~5~
22
14
26
28
~2~
40
42
16

52
54
50
56
46
58

62
48
60
70
44
68
66

~4~

64
~6~

BOX SPRING AND MATTRESS SUPPORT DEVICE

BACKGROUND OF THE INVENTION

The present invention relates to a novel box spring and mattress support device which is useful for aligning a box spring and mattress of a bed.

The modern bed consists of a box spring or lower element and a mattress or upper element which are placed one on top of another and normally depend on friction to maintain alignment. Simple movement on a bed will normally push the mattress from initial alignment with the box springs and will tend to disturb neatly placed coverings such as sheets. Many bed units are supported by rail frames or Hollywood frames which exaserbate the problems since low profile bed frames offer virtually no support against slippage between the mattress and box springs heretofore described. Various prior devices have been employed to prevent persons from falling from beds involuntarily while sleeping or in other unconscious or semiconscious states. It is noted that U.S. Pat. Nos. 2,567,047, 2,601,015, 2,664,576, 2,648,850, 2,751,608 and 3,474,473 describe various methods of connecting guard rails or hand rails to bed frames. U.S. Pat. No. 4,017,919 recognizes the problem presented by stacking a mattress atop of a box spring. In that patent corner braces are employed which rest on the bed frame. The corner braces are restricted to that portion of the bed and may not be used to offer support therebetween. A mechanism for supporting a mattress and box spring in alignment which is easily movable and removable without interference with bed coverings is needed.

SUMMARY OF THE INVENTION

In accordance with the present invention a novel and useful box spring and mattress support device is provided.

The device of the present invention is usable with a box spring and mattress which lie on a bed frame having at least one support member. The device includes an upright member which may extend upwardly adjacent the sides of the box spring and mattress. The upright member may include a sheath on its upper most portion for preventing any damage to persons or objects because of sharp edges or roughness or rigidity inherent in the manufacture of the upright member.

The device also includes clip means for holding the upright member to the supporting member of the bed frame and may be formed by providing an element which extends from the upright member. A channel is formed between the upright member and the element extending therefrom which may fit over the bed frame member and support the upright member adjacent the mattress and box spring. The element extending from the upright member may take the form of a pair of tabs in side by side disposition and possessing a spring equality. Such a feature would allow the easy removal and insertion of the device of the present application at any point along the frame of the bed.

The present invention also encompasses the provision for an extension member for connecting to the upright member where the bed frame extends beneath the box spring and away from side portions thereof. In such a case, means for holding the extension member to the bed frame would also be provided. The extension member may include a portion which fits within the channel of the clip means. Thus, the upright member and clip means which fits directly on the bed frame may also be used with the extension member and the means for holding the extension member to the bed frame.

Such holding means may comprise a slotted member capable of holding the extension member and a portion of the bed frame in adjacent configuration. Also, means for forcing the slotted member and extrusion member into frictional engagement is provided. Thus, the device of the present invention would be capable of fitting on a Hollywood bed frame at any point on the perimeter of the box spring and mattress combination.

It may be apparent that a novel and useful device for supporting a bed frame and mattress has been described.

It is therefore an object of the present invention to provide a box spring and mattress support device which maintains a box spring and mattress in alignment.

It is another object of the present invention to provide a box spring and mattress support device which may be used in conjunction with a rail or Hollywood bed frame.

It is yet another object of the present invention to provide a box spring and mattress support device which may be employed to hold bed covers in place as well as supporting a box spring and mattress in aligned, stacked configuration.

Another object of the present invention is to provide a box spring and mattress support device which is easily installed and removed on a bed frame in a variety of positions and may be employed where the bed frame lies inwardly of the outer perimeter of the box spring and mattress.

Another object of the present invention is to provide a box spring and mattress support device which will not interfere with normal bed related activities.

The present invention possesses other objects and advantages, especially as concerns particular features and characteristics thereof, which will become apparent as the specification continues.

Figures 1, 2, 3, 4, 6:
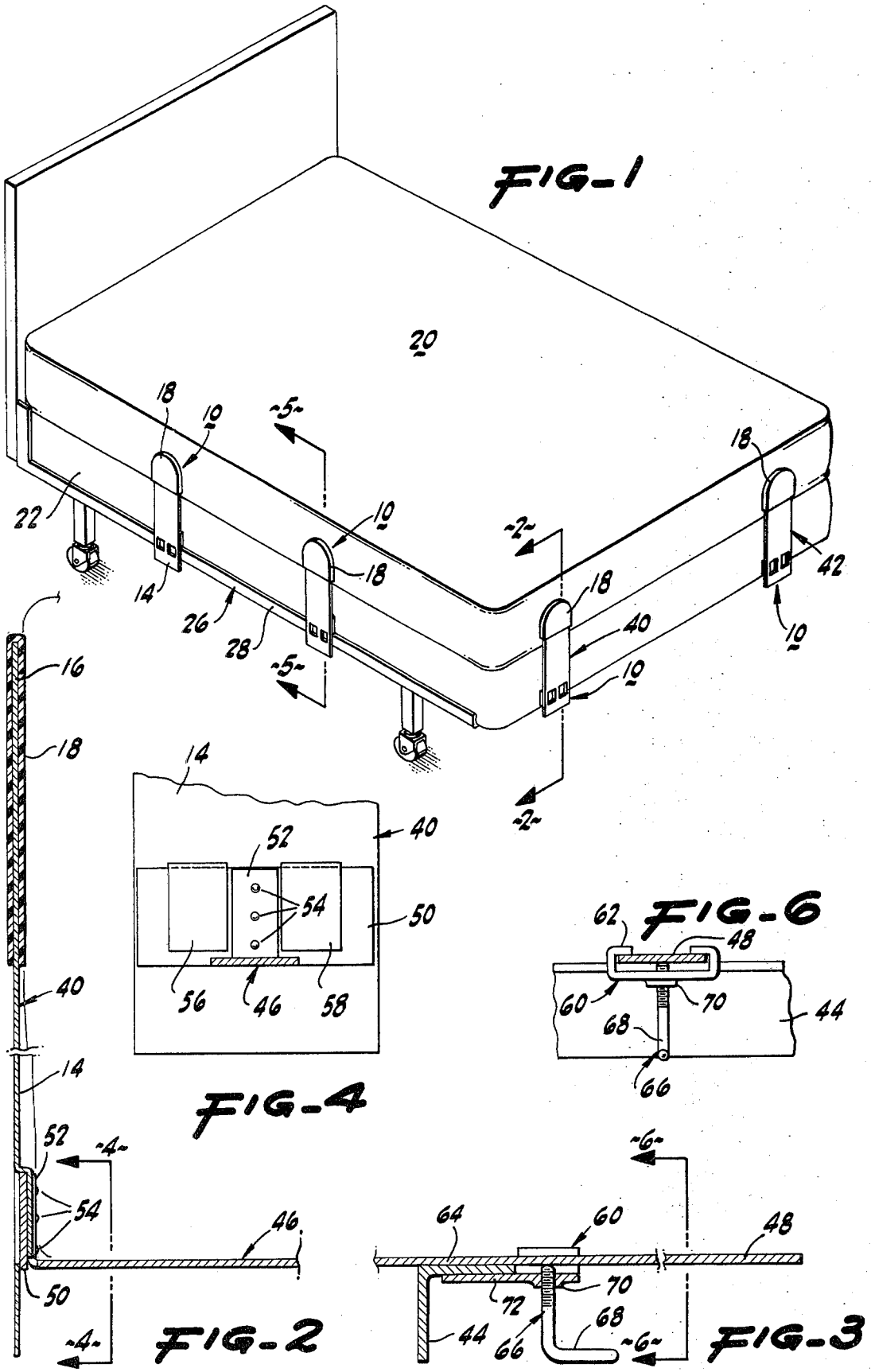
FIG. 1 is a perspective view showing a plurality of the devices of the present application in use on a bed frame.
FIG. 2 is a broken view taken along line 2—2 of FIG. 1.
FIG. 3 is a slightly broken sectional view showing the extension member and holding means at the end portion of the bed.
FIG. 4 is a broken view taken along line 4—4 of FIG. 2.
FIG. 6 is a broken view taken along line 6—6 of FIG. 3.

For a better understanding of the invention, reference is made to the following detailed description.

DESCRIPTION OF THE PREFERRED EMBODIMENTS

Various aspects of the present invention will evolve from the following detailed description of the preferred embodiments thereof which should be taken in conjunction with the heretofore described drawings.

With reference to the drawings the device as a whole is shown and identified by reference character 10. Device 10 includes as one of its elements an upright member 12 which may be constructed of any rigid or semi-rigid material such as wood, metal, plastic and the like, FIG. 5. Upright member 12 may take the form of a plate 14 of rectilinear configuration and having a semi-circular end portion 16, FIGS. 5 and 7. As plate 14 may include sharp edges, roughness, and the like, sheath 18 covers the end portion 16 of plate 14 to prevent damage to persons and objects which may contact end portion 16 of plate 14. Sheath 18 may be padded and include a non-slip surface such that any sheets or other bed coverings placed over mattress 20 and box spring 22 will be held firmly in place, FIG. 1.

Figures 5, 7, 8:
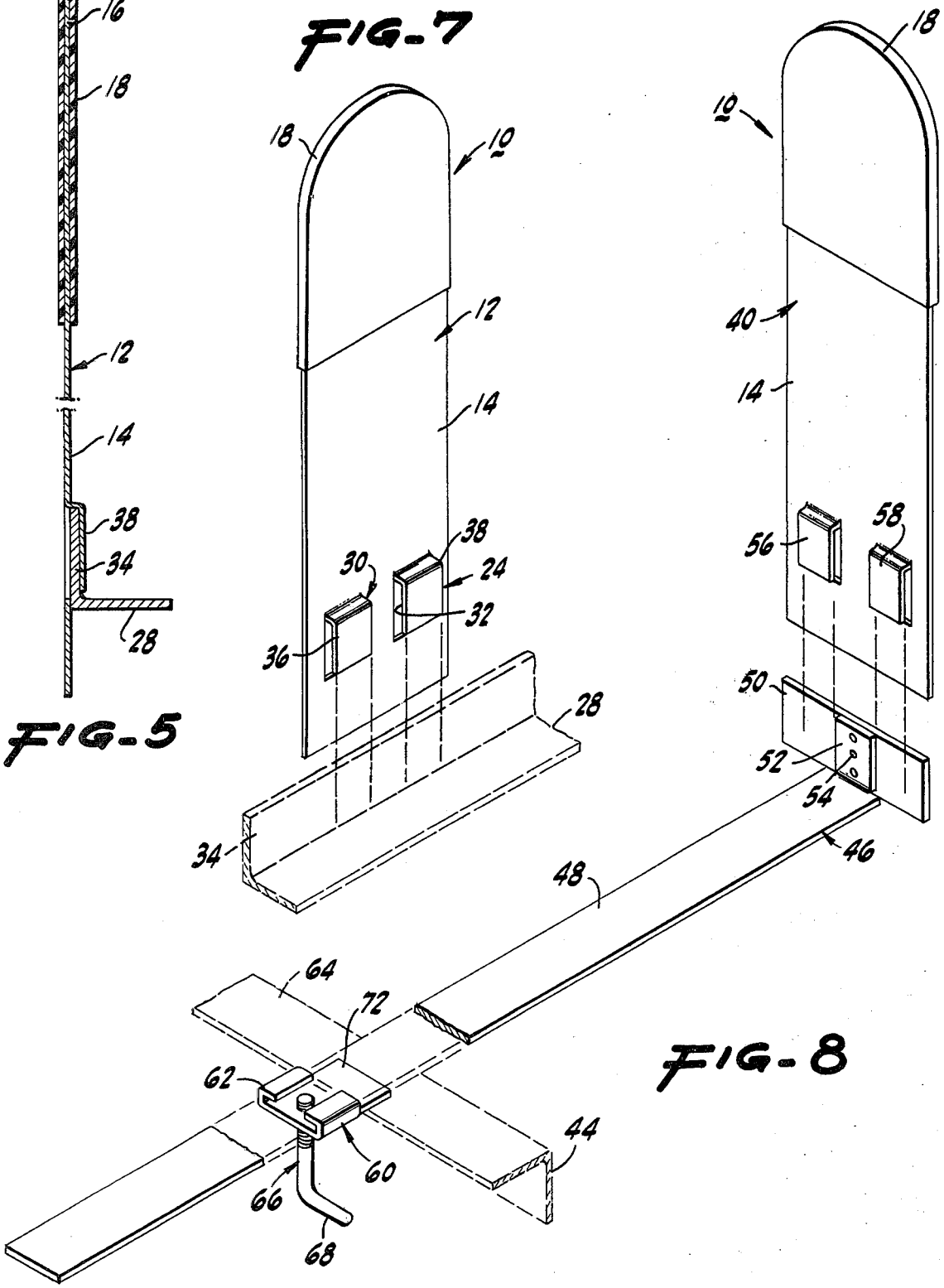
FIG. 5 is a slightly broken view taken along line 5—5 of FIG. 1.
FIG. 7 is a perspective view showing the device of the present invention as removed from a bed frame.
FIG. 8 is a perspective view with sections broken away for convenience showing the use of the present device on a bed frame member located inwardly from the sides of the box spring and mattress.

Device 10 also includes as one of its elements clip means 24 which serves the purpose of holding upright member 12 to the bed frame 26, FIG. 1. Turning to FIG. 7, it may be seen that a member 28 of bed frame 26 of roughly L-shaped configuration may be used to hold device 10. In the embodiment shown in the drawings, clip means takes the form of an element 30 which extends from plate 14 to form a channel 32 between element 30 and plate 14. Channel 32 may be sized to fit over the vertical portion 34 of member 28, depicted in broken lines on FIG. 7. Element 30 may take the form of a pair of tabs 36 and 38 which have been punched from plate 14. Tabs 36 and 38 may possess springiness which would result in a squeezing action on vertical portion 34 when the same is located within channel 32.

Turning to FIG. 1 it may be seen that upright members 40 and 42 gain support from bed frame 26 by a cross member 44, FIG. 8, which is inwardly spaced from the ends of mattress 20 and box spring 22. With reference to FIGS. 2, 3, 4, 6, and 8 it may be seen that device 10 additionally includes an extension member 46 having an elongated bar 48 connected to a cross piece 50 by means of strap 52. Fasteners 54 firmly hold strap 52 to cross piece 50. Upright member 40 fits over cross piece 50, FIG. 8, in the same manner as upright member 12, FIG. 7, fits over member 28. FIGS. 2 and 4 depict the placement of tabs 56 and 58 over cross piece 50.

Means 60 holds extension member 46 to bed frame 26 as shown in FIGS. 3, 6, and 8. Specifically, the embodiment depicted in the drawings illustrates elongated bar 48 crossing atop of member 44. A slotted member 62 holds elongated bar 48 and the generally horizontal portion 64 of member 44 in adjacent configuration. Means 66 forces elongated bar 48 and portion 64 of member 44 into frictional engagement. As shown in FIGS. 3, 6, and 8 means 66 may take the form of a threaded key 68 which fits within an internally threaded nut 70 which is welded to the bottom of slotted member 62. Turning key 68 to travel in an upward direction will cause member 64 to tightly sandwich between horizontal bar 48 and the lower portion 72 of slotted member 62.

In operation the user merely clips device 10 to bed frame 26, eg: by placing vertical portion 34 of member 28 within channel 32. Where bed frame 28 extends inwardly from the perimeter of mattress 20 and box spring 22 the user engages bed frame 26 by the use of extension member 46 and means 60. Specifically, the upper horizontal portion 64 of member 44 is sandwiched between the lower portion 72 of slotted member 62 and horizontal member 48 which also passes through slotted member 62. Threaded key 68 is tightened such that it bears on the lower surface of horizontal bar 48 which creates the holding action heretofore described. The user then clips upright member such as upright members 40 and 42 onto cross piece 50 which extends beyond the perimeter of mattress 20 and box spring 22. Thus, mattress and box spring 20 and 22 are held by a plurality of devices 10 from shifting in relation to one another during use of the same. Also, device 10 may be used to hold bed coverings such as sheets in place. It may be seen that changing sheets or tucking in existing sheets may be easily accomplished with the device of the present application.

While in the foregoing specification embodiments of the present invention have been set forth in considerable detail for the purpose of making a complete disclosure of the invention, it should be apparent to those of ordinary skill in the art that numerous changes may be made in such details without departing from the spirit and principles of the invention.

What is claimed is:

1. A box spring and mattress supporting device useable with a bed frame that includes a supporting member for said box spring and mattress, comprising:

a. an upright member adapted for extending upwardly adjacent the box spring and mattress;

b. clip means for holding said upright member to the supporting member of the bed frame, said clip means including an element extending from said upright member and forming a channel in conjunction with a portion of said upright member; said channel being capable of at least partially surrounding the supporting member, and having a portion of said element extending from said upright member passing over the top portion of the supporting member, said supporting device being adapted to prevent the slippage of said box spring and mattress relative to said frame.

2. The device of claim 1 which additionally comprises a sheath for covering the uppermost portion of said upright member.

3. The device of claim 2 in which said element extending from said upright member comprises a pair of tabs in side-by-side disposition.

4. The device of claim 1 wherein the supporting member additionally comprises an extension member for connection to said upright member and means for holding said extension member to the bed frame.

5. The device of claim 4 in which said extension member includes a portion which fits within said channel of said clip means.

6. The device of claim 5 in which said means for holding said extension member to the bed frame comprises a slotted member capable of holding said extension member and a portion of the bed frame in sandwiched configuration, and means for forcing a portion of the bed frame and said extension member into frictional engagement.

7. The device of claim 6 which additionally comprises a sheath for covering the uppermost portion of said upright member.

8. The device of claim 7 in which said element extending from said upright member comprises a pair of tabs in side-by-side disposition.

* * * * *